United States Patent [19]

Alvi et al.

[11] 3,977,229

[45] Aug. 31, 1976

[54] ANVIL FOR BLIND RIVETING TOOL

[75] Inventors: Zea Raheem Alvi, Hatfield; William David Bradley; Keith Denham, both of Welwyn Garden City; Frederick Arthur Summerlin, Wheathampstead, all of England

[73] Assignee: Aerpat A.G., Zug, Switzerland

[22] Filed: Sept. 10, 1975

[21] Appl. No.: 612,007

[30] Foreign Application Priority Data

Sept. 13, 1974 United Kingdom ..... 39985/74

[52] U.S. Cl. ..... 72/391; 72/476

[51] Int. Cl.[2] ..... B21J 15/34

[58] Field of Search ..... 72/391, 114, 476; 85/77, 78, 72

[56] References Cited

UNITED STATES PATENTS

| | | | |
|---|---|---|---|
| 3,073,205 | 1/1963 | Siebol | 85/78 |
| 3,276,308 | 10/1966 | Bergere | 85/77 |
| 3,695,086 | 10/1972 | Savage | 72/391 |

*Primary Examiner*—Lowell A. Larson
*Assistant Examiner*—Gene P. Crosby
*Attorney, Agent, or Firm*—Oblon, Fisher, Spivak, McClelland & Maier

[57] ABSTRACT

An anvil for a blind riveting tool for locking the plugs of self-plugging blind rivets. The anvil has a central aperture (11), an annular abutment face (13) peripherally of the aperture (11) and a rim (14) radially inwardly of the abutment face (13) and peripherally of the aperture (11). The rim (14) projects forwardly of the abutment face (13) and has a forward end face (16) which is inclined rearwardly and outwardly and provided with generally concave recesses (15) which extend radially across the end face (16) and divide it into a plurality of lands (20) which during placing of a rivet operate to swage part of the mandrel of the rivet into locking engagement with the shell of the rivet.

8 Claims, 7 Drawing Figures

ANVIL FOR BLIND RIVETING TOOL

This invention relates to an anvil for a blind riveting tool for placing blind rivets of the self-plugging type.

Self-plugging blind rivets comprise a tubular shell and a mandrel having a stem and an enlarged head, the stem being provided with a weakened portion or breakneck. The rivet is placed by means of a placing tool which comprises an anvil for abutting the rivet shell and pulling means which pulls the mandrel so as to force the mandrel head into the bore of the rivet shell and thereby expand the shell to form a blind head. Under increasing tension from the tool, the mandrel stem then breaks at the breakneck so that at least a portion of the stem thereof can be discarded, leaving the head and part of the stem plugging the bore of the rivet.

In one particular type of self-plugging blind rivet, the stem of the mandrel is provided with an annular lip which extends in a direction away from the head of the mandrel and which may, at least partly, overlie a breaker groove defining the breakneck in the mandrel stem, the lip being deformable in a radially outward direction to engage the rivet shell and provide an abutment which co-operates with the rivet shell to assist in preventing the mandrel head from becoming disengaged from the shell.

The present invention is concerned with a tool for placing a self-plugging blind rivet of the kind in which the mandrel stem has such an outwardly deformable annular lip, and more particularly with an anvil for such a tool.

According to the present invention there is provided an annular anvil for a blind riveting tool, which annular anvil comprises:- an aperture for receiving the stem of a mandrel;

an annular abutment face surrounding the aperture for abutting the rivet shell;

A forwardly projecting annular rim surrounding the aperture and inside the annular abutment face, the annular rim having a rearwardly and outwardly inclined front end face for engaging the lip on the mandrel stem and swaging it radially outwardly to engage the rivet shell, the said front end face being relieved or recessed at a plurality of zones spaced apart circumferentially around it.

Each recess preferably is shaped so that its wall or face follows a smooth curve from one end to the other in the direction circumferentially of the rim.

Preferably each recess extends rearwardly at least as far as the rearward edge of the front end face of the rim.

In a preferred embodiment of the invention, the circumferential extent of each recess is approximately equal to the circumferential extent of the part of the front end face of the rim between two adjacent recesses.

Preferably the front end face has not less than three recesses and not more than eight recesses. In a preferred embodiment there are four recesses spaced apart equally around the annular front end face. Thus there are two pairs of recesses, the recesses of each pair being diametrically opposite each other and on a diameter at right angles to the diameter defining the position of the other pair.

The invention includes a blind riveting tool incorporating an anvil according to the invention.

A specific embodiment of the invention will now be described by way of example and with reference to the accompanying drawings, in which:-

Figure 1:
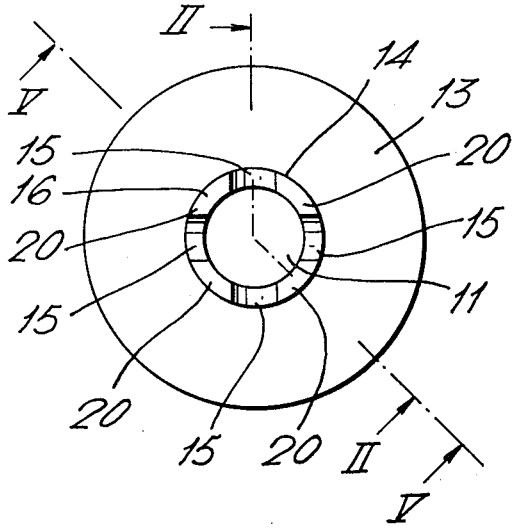
FIG. 1 is an elevation of the forward end of an anvil.

The anvil is made from hardened steel and is in the form of a tubular body having a short axial length compared with its external diameter, and a central cylindrical aperture 11. At one end of the body (the forward end) is a radially projecting flange 12 which has a flat, annular front face 13 which constitutes an abutment face for abutting the shell of a rivet to be placed. Between the aperture 11 and the abutment face 13 is provided an annular rim 14 which extends forwardly from the abutment face and also extends peripherally around the aperture 11. The rim has an annular front end face 16 which is frusto-conical and is inclined rearwardly and outwardly at an angle of 20° to the abutment face 13. The face 16 is divided into four lands 20 by four circumferentially spaced recesses 15. The recesses 15 are similar to each other and each is also approximately equal in peripheral extent to each of the four lands 20 of the front face 16 between adjacent recesses.

Figure 2:
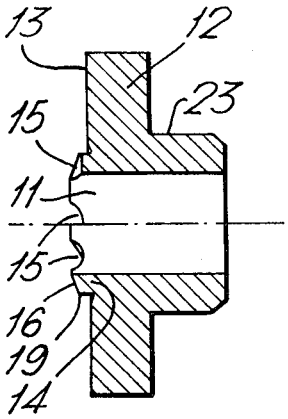
FIG. 2 is a cross section through the anvil taken on the bent line II—II of FIG. 1.
Figure 3:
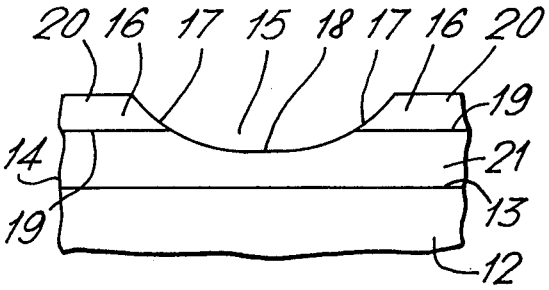
FIG. 3 is a fragmentary side elevation, on an enlarged scale, of part of the anvil showing a recess and the adjacent part of the anvil.

As is shown more clearly in FIG. 3, the surface presented by the rim 14 in each recess comprises two curved portions 17 each being of arcuate form, merging smoothly at their adjacent ends into a short flat surface 18 parallel to the abutment face 13. As shown in FIG. 3, the position of the flat face 18 (i.e. the rearward end of the recess 15) is rearwardly of the radially outer edge 19 of the inclined forward end face 16 of the rim but forwardly of the abutment face 13. As is apparent from FIGS. 1 and 2, the circumferential ends of the recesses in this example are not precisely radial with respect to the aperture 11, since for convenience of manufacture each pair of opposed recesses 15 is made by passing a milling head across the anvil. It would of course be possible for the ends to be truly radial, but this would involve considerable manufacturing difficulties.

Figure 4:
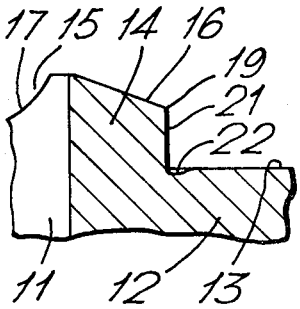
FIG. 4 is a fragmentary radial cross section, on an enlarged scale, through the annular rim and the adjacent part of the abutment face.

FIG. 4 illustrates that the abutment face 13 has a small annular undercut 22 immediately adjacent to the circumferential wall 21 of the rim 14 where it joins the abutment face 13.

In use of the anvil, it is secured in a rivet placing tool 40 (see FIG. 5), by means of the rear part 23 of the outer surface of the tubular body which is externally screw-threaded. As is usual, the rivet placing tool is provided with jaws or other gripping means (not shown in the accompanying drawings) for gripping the mandrel of a rivet and means for retracting the gripping means to apply tension to the mandrel to place the rivet in the way previously described.

Figure 5:
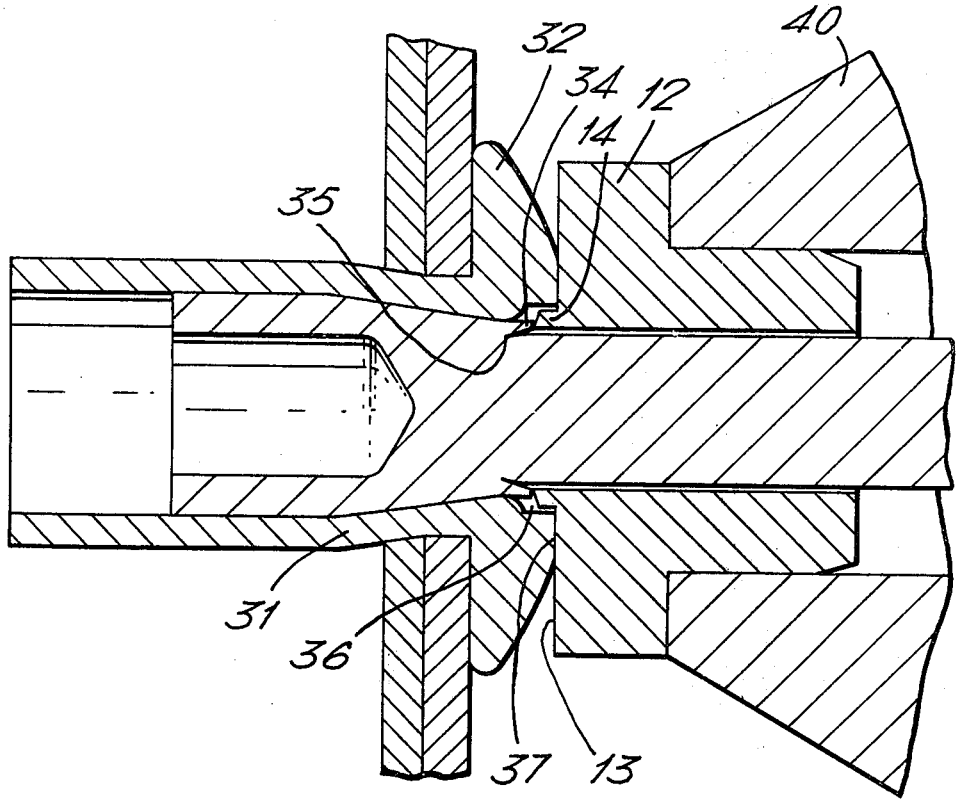
FIG. 5 is a section on the line V—V of FIG. 1 showing the anvil in a blind rivet placing tool and engaging a rivet during a placing operation.

FIG. 5 illustrates the anvil in use with a self-plugging blind rivet of the type which it is intended to place. The rivet comprises a tubular shell 31 having an enlarged head 32 at one end. Through the tubular shell extends a headed mandrel 33 having a small annular lip 34 facing in the direction of the shell head 32 and surrounding a breaker groove 35 which is the weakest part of the mandrel. The shell head 32 includes an annular recess 36 around the mandrel 33, surrounded by an annular head face 37.

Figure 6:
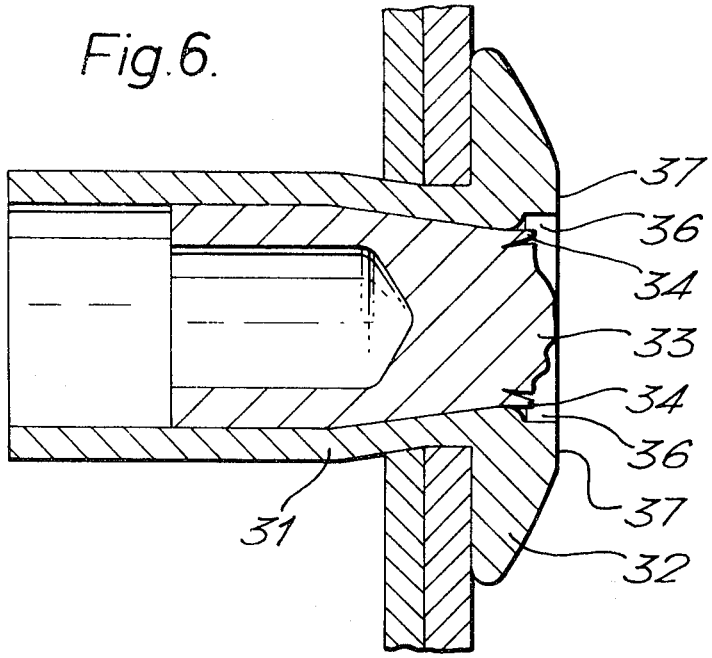
FIGS. 6 and 7 are transverse cross sections on two different planes through a rivet after placing with the anvil.
Figure 7:
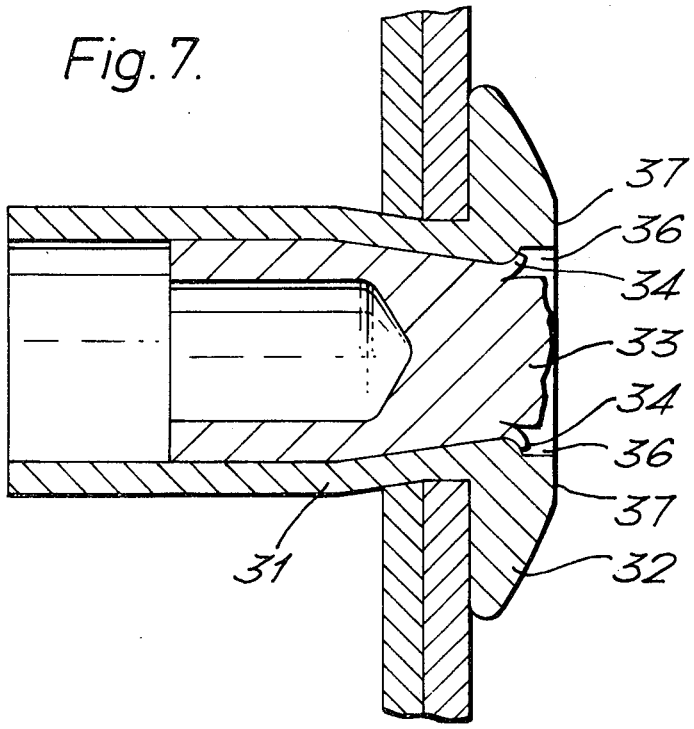

The rivet placing tool is offered up to the rivet so that the mandrel stem enters the aperture 11 of the anvil at the front end and is moved to the position shown in FIG. 5 in which the annular abutment face 13 of the anvil contacts the end face 37 of the rivet shell head. Tension is applied to the mandrel by the placing tool, in order to pull the mandrel further into the placing tool (i.e. towards the right as viewed in FIG. 5). The enlarged mandrel head enters the tail end of the shell to expand it and thereby form a blind head. As the mandrel head is pulled further into the shell, the inclined face 14 of the anvil rim meets the lip 34, and, due to the inclination of the face 14, deforms the lip radially outwards. Those four parts of the mandrel lip 34 which overlie the four lands 20 of the front end face 16 will of course be deformed outwardly and ride along the sloping face 16 of the lands, whilst the alternate four parts of the mandrel lip 34 which overlie the recesses 15 will be relatively undeformed. This difference is apparent from a comparison of FIGS. 6 and 7. FIG. 6 is a section taken through the centres of two opposite recesses 15 (corresponding to the upper half of FIG. 2 and the upper half of the section line 11—11 in FIG. 1), whereas FIG. 7 is a section taken through the centres of two opposed lands 20 (corresponding to the lower half of FIG. 2 and the section line V—V in FIG. 1). It will be seen from FIG. 7 that the parts of the mandrel lip overlying the lands 20 of the end face 16 of the rim of the anvil have been swaged radially outwardly into the rivet head recess 36, thereby locking the rivet stem head into the shell. FIG. 6 shows that those parts of the mandrel lip which enter the four recesses 15 are not swaged radially outwardly, but retain substantially their original positions.

Continuing increase of tension applied by the placing tool to the mandrel stem causes the stem to break at the breaker groove 35, resulting in the condition shown in FIGS. 6 and 7.

The provision of the recesses in the front end face of the anvil which swages the mandrel lip is advantageous in practice over the alternative of a circumferentially continuous swaging face. The recesses in the face ensure that the mandrel lip is stretched circumferentially to a lesser extent than would be the case with a continuous annular deformation face, thus lessening the likelihood of splitting or cracking of the lip when it is deformed. Furthermore, the recesses provide spaces for the accomodation of excess metal material from the mandrel lip which may be thrown up if the deformation pressure (i.e. the pressure with which the lip is crushed between the projections and the rivet shell) is excessive. These problems could be overcome with a continuous annular front end face, but only by making the continuous annular rim radially much thinner than the rim in the anvil of the foregoing example, which weakens the rim so much that its practical life is greatly reduced. Furthermore since the recesses reduce the area of the lip-swaging face (in this example by about 50%), the pressure (i.e. force per unit area) on the mandrel lip is increased (for the same tension on the mandrel stem) thus achieving greater deformation of those parts of the lip which are deformed.

The smooth curvature of the recesses has two advantages over a recess of rectangular shape. Firstly it increases the effective strength of the adjacent parts of the rim which carry the portions 20 of the lip swaging face 16, and secondly it promotes smoother flow and deformation of the lip material at the ends of each recess.

The invention is not restricted to the details of the foregoing example.

We claim:

1. An annular anvil for a blind riveting tool, which anvil is in the form of a tubular body having an aperture for receiving the stem of a mandrel of a self plugging blind rivet, an annular abutment face surrounding the aperture for abutting the shell of a blind rivet, and an annular rim surrounding the aperture and radially within the annular abutment face and projecting forwardly of the abutment face, said annular rim having a front end face which inclines rearwardly and outwardly for engaging a lip on the mandrel stem and swaging the lip radially outwardly to engage the rivet shell, said front end face having a plurality of recesses spaced apart circumferentially around it.

2. An annular anvil according to claim 1, wherein each recess presents a face which curves in the direction circumferentially of said annular rim.

3. An annular anvil according to claim 1, wherein each recess extends radially entirely across the end face of the annular rim.

4. An annular anvil according to claim 1, wherein each recess extends rearwardly at last as far as the radially outer edge of the inclined front end face of the annular rim.

5. An annular anvil according to claim 1, wherein the front end face of the annular rim has not less than three and not more than eight of the recesses.

6. An annular anvil according to claim 1, having four recesses spaced circumferentially of the front end face of the rim, said recesses dividing the front end face into four lands, the peripheral extent of the lands and all the recesses being approximately equal.

7. An annular anvil according to claim 1, wherein the front end face of the annular rim is divided into a number of separate lands by the recesses.

8. An annular anvil according to claim 7, wherein the lands are approximately equal in circumferential extent to the recesses.

* * * * *